United States Patent [19]

Baldwin

[11] 3,944,491

[45] Mar. 16, 1976

[54] LUBRICANTS

[75] Inventor: Bernard A. Baldwin, Bartlesville, Okla.

[73] Assignee: Phillips Petroleum Company, Bartlesville, Okla.

[22] Filed: Jan. 20, 1975

[21] Appl. No.: 542,272

[52] U.S. Cl. ..... 252/45; 72/42; 252/78

[51] Int. Cl.[2]. C10M 1/38; C10M 3/32; C10M 5/22; C10M 7/36

[58] Field of Search ..... 252/45, 78; 72/42

[56] References Cited

UNITED STATES PATENTS

| | | | |
|---|---|---|---|
| 2,110,281 | 3/1938 | Adams et al. | 252/45 |
| 2,417,087 | 3/1947 | Prutton | 252/45 |
| 2,941,945 | 6/1960 | Louthan | 252/45 |
| 3,050,452 | 8/1962 | Lonthan | 204/162 |
| 3,226,445 | 12/1965 | Reifschneider | 252/45 |
| 3,248,235 | 4/1966 | Pryor et al. | 106/3 |
| 3,293,164 | 12/1966 | Warner | 204/158 |
| 3,352,810 | 11/1967 | Cameron et al. | 260/30.8 |
| 3,498,800 | 3/1970 | Warner | 106/14 |
| 3,622,597 | 11/1971 | Fletcher et al. | 252/45 |

FOREIGN PATENTS OR APPLICATIONS

| | | | |
|---|---|---|---|
| 596,859 | 1/1948 | United Kingdom | 252/45 |
| 722,681 | 1/1955 | United Kingdom | 252/45 |

*Primary Examiner*—Delbert E. Gantz
*Assistant Examiner*—I. Vaughn

[57] ABSTRACT

The addition of a small amount of an alkylbenzyl mercaptan to lubricating oils, greases, automatic transmission oils, cutting oils, hydraulic fluids, and the like improves the anti-wear properties of the resulting compositions.

7 Claims, No Drawings

LUBRICANTS

This invention relates to improved lubricants and processes of preparing the same. In accordance with another aspect, this invention relates to mercaptan additive agents which impart to lubricants improved anti-wear characteristics. In accordance with a further aspect, this invention relates to lubricating oils of improved anti-wear properties having incorporated therein a small quantity of an alkylbenzyl mercaptan. In accordance with a still further aspect, this invention relates to alkylbenzyl mercaptan additives for lubricants to improve the anti-wear properties of the resulting compositions.

Many lubricants, such as lubricating motor oil, require efficient anti-wear additives to prevent or reduce scuffing or unreasonable wear caused by contact of moving metal parts. Indeed, such anti-wear additives are essential for the satisfactory lubrication of modern high-compression internal combustion engines.

For many years, a particularly effective anti-wear agent, zinc dialkyldithiophosphate (ZDTP), has been widely used. Despite the fact that this additive has been very effective and very successful in a number of lubricating motor oils, it is presently considered desirable to replace this additive with another. The advent of catalytic exhaust converters on the automobile scene has precluded the use of lead compounds or other similar materials in gasolines in order to prevent premature fouling of the catalysts. Therefore, the elimination of heavy metal compounds such as zinc compounds from motor oils is also under strong consideration in order to avoid the migration of such substances through the combustion chamber and into the catalytic zone. Consequently, a substantial effort has been made to find a replacement for ZDTP which would not only be as effective as that agent but which would also be free of elements as zinc or phosphorus.

The present invention now provides an anti-wear additive which is not only at least as effective as ZDTP but one which contains only the element sulfur in addition to the elements of carbon and hydrogen. Sulfur is generally considered an element which can be tolerated by catalytic exhaust systems.

The invention anti-wear additive of the present invention is an alkylbenzyl mercaptan represented by the formula:

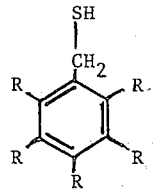

wherein each R is hydrogen or an alkyl group, wherein at least one alkyl group is present in the molecule, and wherein there is a total of from 6 to about 25, preferably from about 10 to about 18 carbon atoms in all of the combined R groups.

Some examples of such compounds are p-dodecylbenzyl mercaptan, m-tetradecylbenzyl mercaptan, 2,4,6-triamylbenzyl mercaptan, 3,5-diisobutylbenzyl mercaptan, o-(2-ethylhexyl)benzyl mercaptan, 2,3-di(4-ethyloctyl)benzyl mercaptan, p-(2,4,6-trimethyldodecyl)benzyl mercaptan, 3-isobutyl-5-tetradecylbenzyl mercaptan, 2,3,4,5,6-pentamylbenzyl mercaptan, and the like, and mixtures thereof.

The anti-wear additives of the present invention can be considered to be derivatives of benzyl mercaptan and, therefore, can be prepared by any suitable means in the art such as by alkylation of benzyl mercaptan with suitable alkylating agents.

The lubricant composition into which the present anti-wear additive can be formulated can be any such lubricating composition in which anti-wear or anti-scuffing protection is desirable. Thus, such compositions can include motor oils, greases, automatic transmission oils, cutting oils, hydraulic fluids, and the like. The present invention additives are found to be particularly suitable for incorporation into motor oil.

These lubricating compositions are based on mineral oils such as those of petroleum origin and are preferably refined mineral oils produced by well-known refining processes employing techniques such as hydrogenation, polymerization, dewaxing, solvent extraction, etc. These oils generally have a Saybolt viscosity at 100°F in the range of about 60 to 5,000 and a Saybolt viscosity at 210°F of from about 30 to 250. The mineral oils can be paraffinic, naphthenic, or aromatic, or mixtures of these.

When such lubricants are in the form of a grease, the lubricant composition will contain a suitable grease thickener such as a lithium soap or a hydrocarbon polymer. Such grease compositions are well known in the art, and they are generally prepared by dissolving soaps and/or polymers in the oil at elevated temperatures.

The amount of invention anti-wear additive incorporated into the lubricating composition will vary according to the nature of the lubricant and the specific lubricating application, but will generally be in the range of from about 0.1 to about 4.0, preferably from about 0.3 to about 2.0, percent by weight of the total lubricating composition.

In addition to the anti-wear additive, the lubricating composition can contain other conventional components such as antioxidants, viscosity index improvers, pour point depressants, anti-foam agents, anti-corrosion agents, and the like.

SPECIFIC EXAMPLES

Example I

The invention anti-wear additive, p-dodecylbenzyl mercaptan, was incorporated into a lubricating motor oil composition. The wear properties of this lubricating composition were then measured by the Falex method using a modified ASTM D 2670–67 method. For purposes of comparison, a similar lubricating composition containing the well-known ZDTP additive was also prepared and its wear properties were also measured.

The lubricating oil composition which was used as a vehicle for these tests was one of commercial motor oil quality and, because of some of its metal-containing components, can generally be described as an ash-containing lubricating motor oil. The composition of this motor oil formulation, with the exception of the anti-wear additive, was as follows:

Table I

| Volume Percent | Description | Purpose |
|---|---|---|
| 86.4 | Lubricating Oil[a] | |
| 7.1 | Phil-Ad 100[b] | Dispersant |
| 4.1 | Lubrizol 934[c] | Ashless Dispersant |
| 2.2 | Phil-Ad VII[d] | Viscosity Index Improver |
| 0.2 | Acryloid 152[e] | Pour Point Depressant |

[a]A refined, generally paraffinic mid-continent lubricating oil blend.
[b]A commercial calcium petroleum sulfonate overbased with lime to give a 100 Base Number.
[c]A mixture of 90 percent by weight polyisobutenyl succinic ester and 10 percent by weight of a mixture of polyisobutenyl succinamide and a succinamide derived from polybutenyl succinic anhydride and alkylene polyamines.
[d]A hydrogenated butadiene-styrene copolymer.
[e]A polymethacrylate-based resin.

As mentioned above, the above composition contains no anti-wear additive and, if subjected to the wear measurement test, results in severe metallic wear.

The wear tests were carried out using the well-known Falex test machine in accordance with a slight modification of the ASTM D 2670–67 procedure. In the procedure used, a rotating steel pin, 0.635 cm (0.25 in.) in diameter was rotated at 290 rpm between two "V" steel blocks for one-half hour of break-in at an applied load of 23 kg (50 lb.) followed by three hours of additional testing at 113 kg (250 lb.) applied load. During this time, the rotating pin and "V" blocks were submerged in 60 ml of the test oil. During thre break-in period, the oil, pin, and "V" blocks were heated to 79.5°C (175°F). However, the temperature was not controlled during the test period but was allowed to increase or decrease depending upon the amount of frictional heat produced during the tests.

The wear was measured by the number of radial degrees of teeth which a ratchet wheel pressure loader must be advanced to maintain a constant pressure during the course of the test. A good lubricant composition would typically result in a wear equivalent to a relatively few teeth (10–20) while a poor lubricating composition would typically require the wheel to be turned through many teeth (50–100). The table below shows additive level in total weight percent added and also in weight percent total sulfur added.

The results of the tests are shown in the table below.

Table II

| Additive Level, Wt. % | | | |
|---|---|---|---|
| Total Wt. Basis | Sulfur Basis | Anti-Wear Agent | Wear (No. of Teeth) |
| 0 | 0 | None | >100 |
| 1 | 0.18 | ZDTP | 12 |
| 2.5 | 0.27 | Dodecylbenzyl mercaptan | 9 |
| 1.6 | 0.18 | Dodecylbenzyl mercaptan | 10 |

The wear results of the table above show that the lubricating motor oil composition, in the absence of any anti-wear agent, results in a very high degree of wear. The data also show that the incorporation of either the ZDTP or the invention additive, dodecylbenzyl mercaptan, greatly reduces the wear to a very acceptable level. With respect to this anti-wear test, the invention mercaptan additive materials appear to be at least as effective as the well-known ZDTP anti-wear agent. Although only one weight percent of the comparative ZDTP material was used in the test, it is believed that the ZDTP test results would have been essentially the same even at the 2.5 weight percent additive level.

Example II

The invention additive, dodecylbenzyl mercaptan, was also tested in another series of tests using, in this instance, an ashless lubricating oil formulation of commercial quality. In addition, several other closely related sulfur-containing materials were also tested for purposes of comparison.

The composition of the lubricating motor oil composition, excluding the anti-wear agent, was as follows:

Table III

| Volume Percent | Description | Purpose |
|---|---|---|
| 88.2 | Lubricating Oil[a] | |
| 7.5 | Lubrizol 934[b] | Ashless Dispersant |
| 2.5 | Phil-Ad VII[c] | Viscosity Index Improver |
| 0.2 | Acryloid 152[d] | Pour Point Depressant |
| 0.1 | Vanlube PN[e] | Antioxidant |
| 0.5 | Ethyl 702[f] | Antioxidant |
| 1.0 | Vanlube SS[g] | Antioxidant |
| 10 ppm | D.C. 200[h] | Foam Depressant |

[a]Same as in Example I.
[b]Same as in Example I.
[c]Same as in Example I.
[d]Same as in Example I.
[e]Phenyl-beta-naphthylamine.
[f]4,4'-Methylenebis(2,6-di-tert-butylphenol).
[g]Mixture of octylated diphenylamines.
[h]A silicone oil.

The wear measurement tests were carried out as in Example I. The results of these tests are shown in the table below. As in Example I, the additive level is shown both on a total weight basis and on a sulfur basis.

Table IV

| Additive Level, Wt. % | | | |
|---|---|---|---|
| Total Wt. Basis | Sulfur Basis | Anti-Wear Agent | Wear (No. of Teeth) |
| 0 | 0 | None | >100 |
| 1 | 0.18 | ZDTP | 24 |
| 2 | 0.36 | ZDTP | 21 |
| 2.5 | 0.27 | Dodecylbenzyl mercaptan | 15 |
| 2.5 | 0.28 | Octadecyl mercaptan | 19 |
| 1 | 0.26 | Benzyl mercaptan | 50 |
| 1 | 0.17 | Phenyl sulfide | 61 |

The data in the table above show that the invention anti-wear additive, dodecylbenzyl mercaptan, is again shown to be at least as effective and possibly even more effective than the well-known ZDTP material. The data also show that the invention dodecylbenzyl mercaptan anti-wear additive is also superior to the closely related octadecyl mercaptan, as well as to the closely related benzyl mercaptan and phenyl sulfide. These data illustrate that not all sulfur-containing organic compounds are equivalent, and that not all are effective as anti-wear agents in lubricating oils.

Example III

In the same manner as in the preceding examples, Falex wear tests were carried out on a heavy white mineral oil of 264 SUS at 100°F. viscosity containing varying amounts of p-dodecylbenzyl mercaptan. The test results showed that p-dodecylbenzyl mercaptan concentrations of 4 weight percent and 1 weight percent were apparently too high in this highly purified white mineral oil which contained no other lubricating oil additives. Both these tests failed, requiring more than 100 teeth. However, another identical test, except at a 0.1 weight percent concentration, required only 39 teeth and thus showed significant wear reduction.

I claim:

1. An improved lubricating composition comprising a mineral lubricating oil having incorporated therein a small quantity sufficient to improve the anti-wear properties of the resulting lubricating composition of an alkylbenzyl mercaptan of the formula

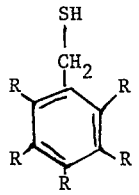

wherein each R is hydrogen or an alkyl group, wherein at least one alkyl group is present in the molecule, and wherein there is a total of from 6 to about 25 carbon atoms in all of the combined R groups.

2. A composition according to claim 1 wherein the quantity of alkylbenzyl mercaptan present ranges from 0.1 to 4 weight percent.

3. A composition according to claim 1 wherein the quantity of alkylbenzyl mercaptan present ranges from 0.3 to 2 weight percent.

4. A composition according to claim 1 wherein there is a total of from about 10 to about 18 carbon atoms in all of the combined R groups of the alkylbenzyl mercaptan.

5. A composition according to claim 1 wherein the alkylbenzyl mercaptan is dodecylbenzyl mercaptan.

6. A composition according to claim 1 wherein the alkylbenzyl mercaptan is dodecylbenzyl mercaptan and the amount of said mercaptan present in the lubricating composition ranges from 0.1 to 4 weight percent.

7. A composition according to claim 1 wherein the lubricating oil has a Saybolt viscosity at 210°F of from about 30 to 250 and the amount of alkylbenzyl mercaptan present ranges from 0.1 to 4 weight percent.

* * * * *